US012241134B2

(12) United States Patent
Park et al.

(10) Patent No.: US 12,241,134 B2
(45) Date of Patent: Mar. 4, 2025

(54) HIGH-STRENGTH HOT-ROLLED PLATED STEEL SHEET, AND METHOD FOR PRODUCING SAME

(71) Applicant: POSCO, Pohang-si (KR)

(72) Inventors: Kyong Su Park, Pohang-si (KR); Jaeyong Chae, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 577 days.

(21) Appl. No.: 16/772,987

(22) PCT Filed: Mar. 6, 2018

(86) PCT No.: PCT/KR2018/002667

§ 371 (c)(1),
(2) Date: Jun. 15, 2020

(87) PCT Pub. No.: WO2019/124638

PCT Pub. Date: Jun. 27, 2019

(65) Prior Publication Data

US 2020/0392595 A1 Dec. 17, 2020

(30) Foreign Application Priority Data

Dec. 22, 2017 (KR) ..... 10-2017-0178850

(51) Int. Cl.

| | |
|---|---|
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C21D 8/0226* (2013.01); *C21D 8/02* (2013.01); *C21D 8/0205* (2013.01); *C21D 9/46* (2013.01); *C22C 38/02* (2013.01); *C22C 38/04* (2013.01); *C22C 38/12* (2013.01); *C22C 38/14* (2013.01); *C22C 38/16* (2013.01); *C21D 8/0263* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 2005/0155673 | A1 | 7/2005 | Soshiroda et al. | |
| 2016/0010168 | A1* | 1/2016 | Angles | C22C 38/02 148/664 |
| 2016/0273066 | A1* | 9/2016 | Sakakibara | C23C 2/06 |
| 2016/0312326 | A1 | 10/2016 | Drillet et al. | |

FOREIGN PATENT DOCUMENTS

| | | | | |
|---|---|---|---|---|
| CN | 105209650 | | 12/2015 | |
| EP | 1396549 | | 3/2004 | |
| JP | 2002322542 | | 11/2002 | |
| JP | 2005298967 | | 10/2005 | |
| JP | 2006161112 | | 6/2006 | |
| JP | 2009209450 | | 9/2009 | |
| KR | 20050113247 | | 12/2005 | |
| KR | 20060033489 | | 4/2006 | |
| KR | 20130046941 | | 5/2013 | |
| KR | 20130070538 | | 6/2013 | |
| KR | 101368547 | | 2/2014 | |
| KR | 20150075307 | | 7/2015 | |
| KR | 20150110749 | | 10/2015 | |
| KR | 20150126683 | | 11/2015 | |
| KR | 101728789 | | 4/2017 | |
| KR | 101748510 | | 6/2017 | |
| WO | WO-2014131907 | A1 * | 9/2014 | C21D 1/84 |
| WO | WO-2014185405 | A1 * | 11/2014 | B21B 1/22 |

OTHER PUBLICATIONS

Chinese Office Action—Chinese Application No. 201880082167.3 issued on Jun. 1, 2021, citing CN 105209650.

International Search Report—PCT/KR2018/002667 dated Aug. 7, 2018.

PCT Written Opinion—PCT/KR2018/002667 issued on Aug. 7, 2018, citing KR 10-2015-0126683 and KR 10-2013-0046941.

* cited by examiner

*Primary Examiner* — Jophy S. Koshy

(74) *Attorney, Agent, or Firm* — CANTOR COLBURN LLP

(57) ABSTRACT

Provided is a high-strength hot-rolled plated steel sheet, including: in a unit of wt %, C at 0.05-0.5 wt %, Mn at 0.1-3.s0 wt %, Si at 0.5 wt % or less (excluding 0 wt %), P at 0.05 wt % or less (excluding 0 wt %), S at 0.03 wt % or less (excluding 0 wt %), Nb at 0.01 wt % or less (excluding 0 wt %), B at 0.0005-0.005 wt %, Ti at 0.005-0.2 wt %, and the remainder of Fe and inevitable impurities, wherein a microstructure thereof includes, as a volume fraction, 90 vol % or more of tempered martensite and 5 vol % or less of one crystal phase of bainite, ferrite, pearlite, and residual austenite; a tensile strength thereof is 650 MPa or more, and a yield strength thereof is 550 MPa or more; and as a ratio of the strengths, a yield ratio (yield strength/tensile strength) is 0.85 or more.

3 Claims, No Drawings

HIGH-STRENGTH HOT-ROLLED PLATED STEEL SHEET, AND METHOD FOR PRODUCING SAME

TECHNICAL FIELD

The present invention relates to a high-strength thin steel sheet and a method for preparing the same. Specifically, the present invention relates to a hot-rolled plated steel sheet and a method for preparing the same that may have high strength and a thin thickness by using hot-rolling and plating heat treatment.

BACKGROUND ART

High-strength hot-rolled plated steel sheet has been widely used for supporting strength. For example, it is variously used in structures using a steel construction material, such as for scaffolds for construction, vinyl house structures, and solar panel supports. This is because the high-strength hot-rolled plated steel sheet has characteristics of preventing deformation and maintaining strength. There is an increasing need to prepare such a structural steel material as a thin steel sheet for high strength and light weight. The following Patent Documents 1 to 7 are known as methods for increasing the strength of the high-strength hot-rolled plated steel sheet. Patent Documents 1 to 4 disclose techniques for securing strength by precipitation strengthening according to addition of alloy elements. These techniques use a conventional method of preparing high-strength low-alloy (HSLA) steel, which requires addition of expensive alloying elements such as Ti, Nb, V, and Mo, thus a preparing cost increases. In addition, since these alloying elements increases a rolling load, it is not possible to prepare a thin object. Meanwhile, Patent Documents 5 to 7 disclose techniques for securing strength by using an abnormal structure composed of ferrite and martensite, or by retaining austenite and utilizing a complex structure of ferrite, bainite, and martensite. However, when the ferrite or a residual austenite crystal phase is used, processability is good, but yield strength is low, so it is not suitable for application of supporting the strength.

(Patent Document 1) Korean Patent Publication No. 2005-113247

(Patent Document 2) Japanese Patent Publication No. 2002-322542

(Patent Document 3) Japanese Patent Publication No. 2006-161112

(Patent Document 4) Korean Patent Publication No. 2006-0033489

(Patent Document 5) Japanese Patent Publication No. 2005-298967

(Patent Document 6) US Patent Publication No. 2005-0155673

(Patent Document 7) European Patent Application No. 2002-019314

DISCLOSURE

Technical Problem

An object of the present invention is to provide a high strength and lightweight hot-rolled plated steel sheet, and a method of preparing the hot-rolled plated steel sheet. Specifically, without adding expensive alloy elements, by utilizing process conditions of an alloy composition and hot-rolling and plating heat treatment, and by reducing a rolling load by alloy elements, a high strength and lightweight hot-rolled plated steel sheet and a method of preparing the hot-rolled plated steel sheet are provided.

Technical Solution

An embodiment of the present invention provides a high-strength hot-rolled plated steel sheet, including: in a unit of wt %, C at 0.05-0.5 wt %, Mn at 0.1-3.0 wt %, Si at 0.5 wt % or less (excluding 0 wt %), P at 0.05 wt % or less (excluding 0 wt %), S at 0.03 wt % or less (excluding 0 wt %), Nb at 0.01 wt % or less (excluding 0 wt %), B at 0.0005-0.005 wt %, Ti at 0.005-0.2 wt %, and the remainder of Fe and inevitable impurities, wherein a microstructure thereof includes, as a volume fraction, 90 vol % or more of tempered martensite and 5 vol % or less of one crystal phase of bainite, ferrite, pearlite, and residual austenite; a tensile strength thereof is 650 MPa or more, and a yield strength thereof is 550 MPa or more; and as a ratio of the strengths, a yield ratio (yield strength/tensile strength) is 0.85 or more.

A thickness of the hot-rolled plated steel sheet is 2.0 mm or less, and the yield strength and the thickness of the steel sheet satisfy [Formula 1].

$$\text{Thickness of steel sheet (mm)} - \text{Yield strength (MPa)}/1000 \leq 1.25 \quad \text{[Formula 1]}$$

The yield strength and the thickness of the steel sheet satisfy [Formula 2].

$$\text{Thickness of steel sheet (mm)} - \text{Yield strength (MPa)}/1000 \leq 0.85 \quad \text{[Formula 2]}$$

The high-strength hot-rolled plated steel sheet may further include Cr at 0.5 wt % or less (excluding 0 wt %).

Another embodiment of the present invention provides a method for preparing a high-strength hot-rolled plated steel sheet, including: preparing a slab including, in a unit of wt %, C at 0.05-0.5 wt %, Mn at 0.1-3.0 wt %, Si at 0.5 wt % or less (excluding 0 wt %), P at 0.05 wt % or less (excluding 0 wt %), S at 0.03 wt % or less (excluding 0 wt %), Nb at 0.01 wt % or less (excluding 0 wt %), B at 0.0005-0.005 wt %, Ti at 0.005-0.2 wt %, and the remainder of Fe and inevitable impurities;

heating the slab;

hot-rolling the slab to prepare a hot-rolled steel sheet;

cooling the hot-rolled steel sheet;

winding the cooled steel sheet;

cooling the wound coil to prepare a hot-rolled coil;

heat-treating the hot-rolled coil; and plating it during the heat-treating, wherein the cooling of the hot-rolled steel sheet includes cooling it at a rate of 50 to 1000° C./s within 5 seconds after rolling end of the hot-rolled steel sheet.

The hot-rolling of the slab includes hot-rolling the steel sheet to a thickness of 2.0 mm or less.

In the cooling of the hot-rolled steel sheet after the rolling end thereof, a temperature (Tcs) at which the cooling is ended is $Tcs=439-423*C-30.4*Mn-12.1*Cr$ (° C.) or less.

In the heat-treating of the cooled hot-rolled coil, a heat treatment temperature is in a temperature range of 400° C. or more to 720° C. or less.

In the hot-rolling of the heated slab, the hot-rolled steel sheet is hot-rolled to a thickness of 1.8 mm or less.

The slab may include Cr at 0.5 wt % or less (excluding 0 wt %).

Advantageous Effects

According to the hot-rolled plated steel sheet prepared by the embodiment of the present invention, it is possible to provide a low-cost, high-strength, thin hot-rolled steel sheet without adding a large amount of expensive alloying elements.

MODE FOR INVENTION

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Therefore, a first part, component, area, layer, or section to be described below may be referred to as second part, component, area, layer, or section within the range of the present invention.

The technical terms used herein are to simply mention a particular embodiment and are not meant to limit the present invention. An expression used in the singular encompasses the expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added.

When referring to a part as being "on" or "above" another part, it may be positioned directly on or above another part, or another part may be interposed therebetween. In contrast, when referring to a part being "directly above" another part, no other part is interposed therebetween.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as having idealized or very formal meanings unless defined otherwise.

Unless otherwise stated, % means % by weight, and 1 ppm is 0.0001% by weight.

Further, in exemplary embodiments of the present invention, inclusion of an additional element means replacing iron (Fe) with an additional amount of the additional elements.

The present invention will be described more fully hereinafter, in which exemplary embodiments of the invention are shown. As those skilled in the art would realize, the described embodiments may be modified in various different ways, all without departing from the spirit or scope of the present invention.

A plated-hot-rolled plated steel sheet according to an embodiment of the present invention includes, in the unit of wt %, C at 0.05-0.5 wt %, Mn at 0.1-3.0 wt %, Si at 0.5 wt % or less (excluding 0 wt %), P at 0.05 wt % or less (excluding 0 wt %), S at 0.03 wt % or less (excluding 0 wt %), Nb at 0.01 wt % or less (excluding 0 wt %), B at 0.0005-0.005 wt %, Ti at 0.005-0.2 wt %, and the remainder of Fe and inevitable impurities.

First, the reason for limiting the components of the hot-rolled plated steel sheet will be described.

Carbon (C): 0.05-0.5 wt %

Carbon is not only an essential element for improving the strength of the steel sheet, but also needs to be properly added to secure the microstructure to be implemented in the present invention. When a content of the carbon is less than 0.05 wt %, the carbon is first transformed into ferrite and pearlite during cooling after hot-rolling, thus it is difficult to secure a desired tempered martensite structure of 90 wt % or more. In contrast, when the content of the carbon exceeds 0.5 wt %, cracks occur in the steel sheet during cooling after hot-rolling, or when it is used for a steel construction material, it causes low weldability. Therefore, in the present invention, the content of C is preferably 0.05-0.5 wt %.

Manganese (Mn): 0.1-3.0 wt %

Manganese not only improves the strength and hardenability of steel, but also combines with sulfur(S), which is inevitably contained in the steel preparing process, to form MnS, thereby suppressing crack generation by the sulfur(S). In order to obtain such an effect in the present invention, it is preferable that a content of manganese is 0.1 wt % or more. In contrast, when it exceeds 3.0 wt %, since it lowers weldability and increases a price, in the present invention, the content of Mn is preferably 0.1-3.0 wt %.

Silicon (Si): 0.5 wt % or less (excluding 0 wt %)

Silicon not only acts as a deoxidizer, but also serves to improve the strength of the steel sheet. In addition, it is utilized in a steel type that requires tissue control, such as DP steel or Trip steel. However, when a content of the silicon exceeds 0.5 wt %, since a scale is formed on a surface of the steel sheet, surface quality of the steel sheet decreases and weldability also decreases, thus the content of Si in the present invention is preferably 0.5 wt % or less.

Phosphorus (P): 0.05 wt % or less (excluding 0 wt %)

Phosphorus is an inevitably contained impurity in the steel, and it is preferable to control it as low as possible because it is an element that is formed at grain boundaries and is a major cause of deteriorating toughness of steel. In theory, it is advantageous to limit a content of P to 0 wt %, but it is inevitably contained in a preparing process. Therefore, it is important to manage an upper limit thereof, and in the present invention, it is preferable to set the upper limit of P to 0.05 wt %.

Sulfur(S): 0.03 wt % or less (excluding 0 wt %)

The sulfur is an inevitably contained impurity in the steel, and reacts with manganese to form MnS to increase a content of precipitates, and is a major factor in embrittling the steel. Therefore, it is desirable to control it as low as possible. In theory, it is advantageous to limit a content of S to 0 wt %, but it is inevitably contained in a preparing process. Therefore, it is important to manage an upper limit thereof, and in the present invention, it is preferable to set the upper limit of S to 0.03 wt %.

Niobium (Nb): 0.01 wt % or less (excluding 0 wt %)

Niobium reacts with carbon or nitrogen to form NbC or NbN to increase a content of precipitates. However, since the niobium is an expensive alloying element, a price increases with an amount of addition thereof, and thus, it is preferable to set an upper limit of the Nb to 0.01 wt % in the present invention.

Boron (B): 0.0005-0.005 wt %

Boron is an element that plays an important role in improving hardenability of the steel sheet, and suppresses transformation of ferrite or pearlite during cooling after completion of rolling. In order to obtain such an effect in the present invention, it is preferable that a content of the boron is 0.0005 wt % or more. Meanwhile, when it exceeds 0.005 wt %, since the excessively added boron combines with Fe to make grain boundaries vulnerable, the content of the boron is preferably 0.0005-0.005 wt %.

Titanium (Ti): 0.005-0.2 wt %

Titanium is an element that combines with carbon or nitrogen to form carbides and nitrides. In the present invention, it was intended to secure the hardenability by adding boron, however, in this case, an effect of adding the boron may be improved by titanium combining with nitrogen before the boron combines with nitrogen. In order to obtain such an effect in the present invention, it is preferable that a content of the titanium is 0.005 wt % or more. In contrast, when it exceeds 0.2 wt %, the excessively added titanium causes a decrease in a soft cast characteristic in a slab preparing step. Therefore, the content of titanium is preferably 0.005-0.2 wt %.

Chromium (Cr): 0.5 wt % or less

Chromium is selectively added, and the chromium serves to improve the strength of the steel sheet, and is also used for tissue control in DP steel or Trip steel. However, when a content of chromium exceeds 0.5 wt %, since weldability is lowered and a price increases with an expensive alloying element, the content of Cr in the present invention is preferably 0.5 wt % or less.

In addition to the above components, the present invention includes Fe and inevitable impurities. Addition of effective components other than the above components is not excluded.

Meanwhile, the present invention provides a high-strength thin hot-rolled plated steel sheet suitable for a purpose of having high strength and light weight. To this end, a steel plate having a thickness of 2.0 mm or less is provided by minimizing alloy elements such as niobium or chromium, which increase a rolling load.

According to a method of directly preparing a hot-rolled steel sheet having a thickness of 2.0 mm or less by hot-rolling from a slab, by roughly rolling the slab, then by bonding the rolled steel sheets before and after, and then by continuously performing successive finishing rolling, a thin steel sheet may be prepared. Another method of directly preparing a hot-rolled steel sheet of 2.0 mm or less may use a method of preparing a thin hot-rolled steel sheet by a mini mill. In addition, any method of directly preparing a hot-rolled steel sheet having a thickness of 2.0 mm or less by hot-rolling from a slab is applicable.

In this case, yield strength and a thickness of the steel sheet satisfy the following [Formula 1] to provide a steel sheet suitable for a purpose of a high-strength thin object.

$$\text{Thickness of steel sheet (mm)} - \text{Yield strength (MPa)}/1000 \leq 1.25 \quad \text{[Formula 1]}$$

In addition, more preferably, a high-strength thin plated steel sheet satisfying the following [Formula 2] is provided.

$$\text{Thickness of steel sheet (mm)} - \text{Yield strength (MPa)}/1000 \leq 0.85 \quad \text{[Formula 2]}$$

Next, a microstructure and mechanical properties of the high-strength thin hot-rolled plated steel sheet of the present invention will be described in detail.

It is preferable that the steel sheet of the present invention not only satisfies the above component system, but also contains 90 vol % or more of tempered martensite as a microstructure of the steel sheet. When a volume of the tempered martensite is less than 90 vol %, it is difficult to sufficiently secure a required yield ratio and high strength. In addition, it is preferable that the ferrite, pearlite, and residual austenite crystal phases in the microstructure of the steel sheet, respectively or totally, are contained at 5 wt % or less. When the ferrite, pearlite, and residual austenite exceed 5 vol %, it is difficult to sufficiently secure a yield ratio due to low yield strength. Meanwhile, in addition to the above-described structure, as the remainder, cementite, precipitates, and the like may be included.

Meanwhile, it is preferable that the tensile strength of the steel sheet of the present invention satisfies 650 MPa or more, the yield strength thereof satisfies 550 MPa or more, and the yield ratio (yield strength/tensile strength) thereof, which is the ratio of the strengths, satisfies 0.85 or more. When the strength thereof is low, it cannot be properly used for structures requiring high strength, and particularly, when the yield strength thereof is low, it may cause problems in supporting the strength. Therefore, although it does not contain expensive alloying elements, it is desirable to satisfy the above strength.

Hereinafter, a method of preparing a high-strength hot-rolled plated steel sheet having excellent yield ratio of the present invention will be described in detail.

First, a slab satisfying the above-described composition is prepared.

A hot-rolled steel sheet is prepared by heating and then hot-rolling the prepared slab. In this case, the slab may be used as it is without being heated, as long as it is at a sufficient temperature to perform general hot-rolling in an uncooled state.

In addition, it is preferable to directly roll a thickness of the hot-rolled steel sheet to 1.8 mm or less in the hot-rolling of the heated slab.

The hot-rolled steel sheet is preferably cooled to a temperature range below a cooling end temperature (referred to as "Tcs") at a rate of 50 to 1000° C./s within 5 seconds after the rolling ends. At this time, the cooling end temperature (Tcs) is varied depending on contents of the component elements of the steel sheet, and the cooling end temperature (Tcs) is preferably $Tcs=439-423*C-30.4*Mn-12.1*Cr$ (° C.).

When a waiting time after the rolling end exceeds 5 seconds, transformation into ferrite and pearlite occurs during the waiting or cooling, so that the strength intended by the present invention may not be secured. In addition, even when the cooling rate is 50° C./s or less, transformation into ferrite and pearlite occurs during the cooling, and in this case, the strength intended by the present invention may not be secured. The faster the cooling rate, the more advantageous, but in order to exceed 1000° C./s, a special device is required, and this conflicts with the purpose of excluding the expensive alloying elements, which is sought by the present invention. Meanwhile, even when the cooling end temperature exceeds 500° C., transformation into ferrite and pearlite occurs, so that the desired strength may not be secured.

The cooled hot-rolled coil is subjected to plating heat treatment, and in this case, the heat treatment is preferably performed in a temperature range of 400° C. to 720° C. When the heat treatment temperature is less than 400° C., the plating treatment is not properly performed. During the preparing process of the hot-rolled steel sheet, a controlled microstructure is reversely transformed, and then, a structure such as ferrite and pearlite are formed in the cooling process, so that the desired strength may not be secured.

In the present invention, in the plating performed during the plating heat treatment, the plating metal is not particularly limited, and an example, which is not limited, may include a hot-dip plating metal (for example, Zn, Zn—Al, Zn—Al—Mg) including one or more of Zn, Al, and Mg.

Hereinafter, examples of the present invention will be described in more detail. However, it is necessary to note that the following examples are only intended to illustrate the present invention in more detail and are not intended to limit the scope of the present invention. This is because the scope of the present invention is determined by constituent elements described in the claims and reasonably inferred therefrom.

Example

After preparing a steel sheet having the composition (% by weight, the remainder is Fe and inevitable impurities) of Table 1 below, the steel sheet was prepared under the conditions of Table 2 below. Thereafter, a microstructure of the steel sheet was observed, and mechanical properties thereof were measured and are shown in Table 3 below.

The microstructure was measured using an optical microscope and a scanning electron microscope, and then measured through image analysis.

An experiment for the mechanical properties was conducted in a C direction by using a DIN standard. In addition, as a material characteristic targeted in the present invention, a yield ratio was calculated as a ratio of yield strength and tensile strength, that is, [yield ratio=yield strength/tensile strength].

TABLE 1

| Steel type | C | Mn | Si | P | S | Cr | Ti | Nb | B | Cooling end temperature (Tcs) |
|---|---|---|---|---|---|---|---|---|---|---|
| Inventive Steel 1 | 0.156 | 1.05 | 0.07 | 0.012 | 0.003 | 0.03 | 0.019 | 0.001 | 0.0019 | 341 |
| Inventive Steel 2 | 0.247 | 1.04 | 0.06 | 0.012 | 0.004 | 0.02 | 0.018 | 0.002 | 0.0021 | 303 |
| Inventive Steel 3 | 0.351 | 0.97 | 0.08 | 0.014 | 0.003 | 0.02 | 0.022 | 0.001 | 0.0021 | 261 |
| Inventive Steel 4 | 0.149 | 1.98 | 0.06 | 0.010 | 0.003 | 0.03 | 0.021 | 0.001 | 0.0017 | 315 |
| Inventive Steel 5 | 0.152 | 1.01 | 0.08 | 0.011 | 0.002 | 0.02 | 0.048 | 0.001 | 0.0018 | 344 |
| Inventive Steel 6 | 0.153 | 1.04 | 0.07 | 0.015 | 0.004 | 0.05 | 0.029 | 0.002 | 0.0031 | 342 |
| Comparative Steel 1 | 0.031 | 0.99 | 0.07 | 0.014 | 0.003 | 0.03 | 0.021 | 0.001 | 0.0021 | 395 |
| Comparative Steel 2 | 0.147 | 1.03 | 0.06 | 0.015 | 0.004 | 0.02 | 0.001 | 0.002 | 0.0020 | 345 |
| Comparative Steel 3 | 0.153 | 0.98 | 0.07 | 0.012 | 0.004 | 0.02 | 0.019 | 0.001 | 0.0002 | 344 |
| Comparative Steel 4 | 0.154 | 0.99 | 0.07 | 0.013 | 0.003 | 0.02 | 0.019 | 0.017 | 0.0019 | 344 |
| Comparative Steel 5 | 0.154 | 0.99 | 0.31 | 0.013 | 0.003 | 0.02 | 0.019 | 0.001 | 0.0021 | 344 |

TABLE 2

| Steel type | Rolling end temperature (° C.) | Rolling thickness (mmt) | Rolling end~cooling start time (s) | Cooling speed (° C./s) | Cooling end temperature (° C.) | Heat treatment temperature (° C.) |
|---|---|---|---|---|---|---|
| Inventive Steel 1 | 885 | 1.4 | 0.9 | 100 | 157 | 603 |
| Inventive Steel 1 | 879 | 1.4 | 1.0 | 200 | 81 | 601 |
| Inventive Steel 1 | 886 | 1.2 | 0.8 | 100 | 147 | 524 |
| Inventive Steel 1 | 885 | 1.2 | 1.1 | 100 | 140 | 643 |
| Inventive Steel 1 | 880 | 1.4 | 3.1 | 100 | 155 | 599 |
| Inventive Steel 2 | 881 | 1.6 | 1.2 | 100 | 161 | 569 |
| Inventive Steel 3 | 885 | 1.6 | 1.1 | 100 | 145 | 591 |
| Inventive Steel 4 | 891 | 1.5 | 0.9 | 100 | 171 | 609 |
| Inventive Steel 5 | 889 | 1.5 | 1.2 | 100 | 139 | 601 |
| Inventive Steel 6 | 885 | 1.4 | 0.7 | 100 | 144 | 604 |
| Inventive Steel 1 | 873 | 1.4 | 10.9 | 100 | 161 | 609 |
| Inventive Steel 1 | 891 | 1.4 | 0.8 | 30 | 166 | 589 |
| Inventive Steel 1 | 875 | 1.4 | 0.7 | 100 | 608 | 593 |

TABLE 2-continued

| Steel type | Rolling end temperature (° C.) | Rolling thickness (mmt) | Rolling end~cooling start time (s) | Cooling speed (° C./s) | Cooling end temperature (° C.) | Heat treatment temperature (° C.) |
|---|---|---|---|---|---|---|
| Inventive Steel 1 | 890 | 1.4 | 0.8 | 100 | 144 | 792 |
| Comparative Steel 1 | 888 | 1.2 | 1.1 | 100 | 175 | 587 |
| Comparative Steel 2 | 878 | 1.4 | 1.2 | 100 | 171 | 612 |
| Comparative Steel 3 | 877 | 1.4 | 1.1 | 100 | 144 | 604 |
| Comparative Steel 4 | 881 | 2.0 | 0.9 | 100 | 151 | 599 |
| Comparative Steel 5 | 879 | 2.0 | 0.9 | 100 | 151 | 611 |

TABLE 3

| Steel type | Ferrite fraction (%) | Perlite fraction (%) | Bainite fraction (%) | Tempered martensite fraction (%) | Residual austenite fraction (%) | Tensile strength (MPa) | Yield strength (MPa) | Yield ratio | Thickness-Yield strength/1000 | Remarks |
|---|---|---|---|---|---|---|---|---|---|---|
| Inventive Steel 1 | 0 | 0 | 3 | 96 | 1 | 757 | 700 | 0.92 | 0.7 | Inventive Example 1 |
| Inventive Steel 1 | 0 | 0 | 1 | 99 | 0 | 771 | 710 | 0.92 | 0.7 | Inventive Example 2 |
| Inventive Steel 1 | 0 | 0 | 3 | 96 | 1 | 873 | 823 | 0.94 | 0.4 | Inventive Example 3 |
| Inventive Steel 1 | 0 | 0 | 3 | 96 | 1 | 719 | 659 | 0.92 | 0.5 | Inventive Example 4 |
| Inventive Steel 1 | 1 | 1 | 5 | 92 | 1 | 749 | 698 | 0.93 | 0.7 | Inventive Example 5 |
| Inventive Steel 2 | 0 | 0 | 0 | 99 | 1 | 878 | 796 | 0.91 | 0.8 | Inventive Example 6 |
| Inventive Steel 3 | 0 | 0 | 0 | 99 | 1 | 901 | 833 | 0.92 | 0.8 | Inventive Example 7 |
| Inventive Steel 4 | 0 | 0 | 0 | 97 | 3 | 765 | 688 | 0.90 | 0.8 | Inventive Example 8 |
| Inventive Steel 5 | 0 | 0 | 2 | 97 | 1 | 773 | 720 | 0.93 | 0.8 | Inventive Example 9 |
| Inventive Steel 6 | 0 | 0 | 1 | 98 | 1 | 761 | 712 | 0.94 | 0.7 | Inventive Example 10 |
| Inventive Steel 1 | 15 | 5 | 12 | 67 | 1 | 667 | 530 | 0.79 | 0.9 | Comparative Example 1 |
| Inventive Steel 1 | 7 | 16 | 51 | 26 | 0 | 622 | 493 | 0.79 | 0.9 | Comparative Example 2 |
| Inventive Steel 1 | 17 | 54 | 29 | 0 | 0 | 510 | 378 | 0.74 | 1.0 | Comparative Example 3 |
| Inventive Steel 1 | 37 | 61 | 2 | 0 | 0 | 494 | 351 | 0.71 | 1.0 | Comparative Example 4 |
| Comparative Steel 1 | 92 | 1 | 7 | 0 | 0 | 386 | 267 | 0.69 | 0.9 | Comparative Example 5 |
| Comparative Steel 2 | 5 | 17 | 32 | 46 | 0 | 649 | 511 | 0.79 | 0.9 | Comparative Example 6 |
| Comparative Steel 3 | 23 | 37 | 17 | 23 | 0 | 603 | 496 | 0.82 | 0.9 | Comparative Example 7 |
| Comparative Steel 4 | 0 | 0 | 3 | 96 | 1 | 773 | 721 | 0.93 | 1.3 | Comparative Example 8 |
| Comparative Steel 5 | 0 | 0 | 1 | 98 | 1 | 781 | 719 | 0.92 | 1.3 | Comparative Example 9 |

As disclosed in Table 3, it can be confirmed that all of Inventive Examples 1 to 10 satisfying the alloy composition and preparing conditions proposed by the present invention had ferrite, pearlite, and residual austenite fractions within 5%, and the main crystal phase was composed of tempered martensite. Based on the characteristics of these structures, it can be confirmed that the tensile strength was 650 MPa or more, the yield strength was 550 MPa or more, and the yield ratio was 0.85 or more.

In contrast, it can be seen that in Comparative Example 1, after the rolling end, the cooling start time was long, resulting in the high ferrite fraction and thus poor strength. In addition, it can be seen that Comparative Examples 2 and 3 had the low cooling rate or the high cooling end temperature, so they were transformed into ferrite and pearlite during the cooling, and thus the strength was poor.

It can be seen that In Comparative Example 4, the heat treatment temperature was high, and the initial microstructure formed after the hot-rolling was transformed into ferrite and pearlite after the heat treatment, and thus the strength was poor. It can be seen that In Comparative Examples 5 to 7, carbon, titanium, boron, and the like were out of the required component range, and thus the strength was poor.

Meanwhile, it can be seen that Comparative Example 8 and Comparative Example 9 had the characteristic that the content of niobium and chromium was high and thus the rollable thickness was high. According to these comparative examples, a high-strength steel sheet may be prepared, but the thickness thereof is thick, thus it is difficult to realize light weight of a high-strength thin object.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described exemplary embodiments are for illustrative purposes only, and the scope of the present invention is not limited thereto.

The invention claimed is:

1. A high-strength hot-rolled plated steel sheet, comprising consisting of:

in a unit of wt %, C at 0.05-0.5 wt %, Mn at 0.1-3.0 wt %, Si at 0.08 wt % or less excluding 0 wt %, P at 0.05 wt % or less excluding 0 wt %, S at 0.03 wt % or less excluding 0 wt %, Nb at 0.01 wt % or less excluding 0 wt %, B at 0.0005-0.005 wt %, Ti at 0.005-0.2 wt %, Cr at 0.5 wt % or less excluding 0 wt %, and a remainder of Fe and inevitable impurities, wherein a microstructure thereof includes, as a volume fraction, 90 vol % or more of tempered martensite and 5 vol % or less of at least one of bainite, ferrite, pearlite, and residual austenite;

a tensile strength thereof is 719 MPa to 901 MPa, and a yield strength thereof is 659 MPa to 833 MPa; and a ratio of yield strength to tensile strength is 0.85 or more, wherein a thickness of the steel sheet is 1.8 mm or less, and wherein the yield strength and the thickness of the steel sheet satisfy [Formula 1]:

Thickness of steel sheet in a unit of mm−Yield strength in a unit of MPa/1000≤1.25. [Formula 1]

2. The high-strength hot-rolled plated steel sheet of claim 1, wherein the yield strength and the thickness of the steel sheet satisfy [Formula 2]:

Thickness of steel sheet in a unit of mm−Yield strength in a unit of MPa/1000≤0.85. [Formula 2]

3. A method for preparing a hot-rolled plated steel sheet, comprising:

preparing a slab consisting of, in a unit of wt %, C at 0.05-0.5 wt %, Mn at 0.1-3.0 wt %, Si at 0.08 wt % or less excluding 0 wt %, P at 0.05 wt % or less excluding 0 wt %, S at 0.03 wt % or less excluding 0 wt %, Nb at 0.01 wt % or less excluding 0 wt %, B at 0.0005-0.005 wt %, Ti at 0.005-0.2 wt %, Cr at 0.5 wt % or less excluding 0 wt %, and a remainder of Fe and inevitable impurities;

heating the slab to form a heated slab;

hot-rolling the heated slab to prepare a hot-rolled steel sheet;

cooling the hot-rolled steel sheet to form a cooled steel sheet;

winding the cooled steel sheet to form a wound coil;

cooling the wound coil to prepare a cooled hot-rolled coil; and plating heat-treating the cooled hot-rolled coil to form a hot-rolled plated steel sheet, wherein the cooling of the hot-rolled steel sheet includes:

cooling the hot-rolled steel sheet at a rate of 50 to 1000° C./s within 5 seconds, wherein the hot-rolled plated steel sheet has a tensile strength of 650 MPa or more and a yield strength of 550 MPa or more, wherein in the cooling of the hot-rolled steel sheet, a temperature (Tcs) at which the cooling is ended is equal to (439−423*C−30.4*Mn−12.1*Cr° C.) or less, wherein in the plating heat-treating of the cooled hot-rolled coil, a heat treatment temperature is in a temperature range of 400° C. or more to 720° C. or less, and wherein in the hot-rolling of the heated slab to prepare the hot-rolled steel sheet, the heated slab is hot-rolled to a thickness of 1.8 mm or less, and wherein the yield strength and the thickness of the steel sheet satisfy [Formula 1]:

Thickness of steel sheet in a unit of mm−Yield strength in a unit of MPa/1000≤1.25. [Formula 1]

* * * * *